US005582361A

United States Patent [19]

Müller et al.

[11] Patent Number: 5,582,361

[45] Date of Patent: Dec. 10, 1996

[54] SUPPORT ROLLER FOR PAPER-WINDING MACHINE

[75] Inventors: Georg Müller, Neuss; Reinhard Hehner, Haan, both of Germany

[73] Assignee: Jagenberg Papiertechnik GmbH, Neuss, Germany

[21] Appl. No.: 428,297

[22] Filed: Apr. 25, 1995

[30] Foreign Application Priority Data

Apr. 26, 1994 [DE] Germany ..... 44 14 396.6

[51] Int. Cl.[6] ..... B65H 18/10; B65H 18/16

[52] U.S. Cl. ..... 242/542.4; 242/547

[58] Field of Search ..... 242/542.4, 547, 242/541.1

[56] References Cited

U.S. PATENT DOCUMENTS

| | | | |
|---|---|---|---|
| 3,503,567 | 3/1970 | Casey | 242/542.4 |
| 3,702,687 | 11/1972 | Hall | 242/542.4 |
| 4,026,487 | 5/1977 | Ales | 242/542.4 |
| 4,576,344 | 3/1986 | Sasaki et al. | 242/547 |
| 5,039,023 | 8/1991 | Hagens et al. | 242/547 |
| 5,071,083 | 12/1991 | Tubota et al. | 242/547 |
| 5,240,198 | 8/1993 | Dorfel | 242/542.4 |

FOREIGN PATENT DOCUMENTS

| | | | |
|---|---|---|---|
| 0274096 | 7/1988 | European Pat. Off. . | |
| 0521681 | 1/1993 | European Pat. Off. . | |
| 562266 | 9/1993 | European Pat. Off. . | |
| 3102894 | 8/1982 | Germany . | |
| 3924612 | 1/1991 | Germany . | |
| 4012979 | 11/1991 | Germany . | |
| 258350 | 10/1988 | Japan | 242/542.4 |

*Primary Examiner*—John M. Jillions
*Attorney, Agent, or Firm*—Herbert Dubno; Andrew Wilford

[57] ABSTRACT

In a paper-winding machine a paper web passes at least partially around a support roller rotating about an axis and the web is wound up on a windup roll bearing radially on the support roller. The support roller comprises a rigid tubular core having a substantially cylindrical outer surface and an outer layer of material on the outer surface. The layer of material has a thickness between 5 mm and 12 mm (preferably 6 mm to 8 mm), the material is a low-friction elastomer (preferably a nitrile or polyurethane rubber), and the material has a Shore A hardness of between 65 and 80 (preferably 70 to 74).

9 Claims, 1 Drawing Sheet

SUPPORT ROLLER FOR PAPER-WINDING MACHINE

FIELD OF THE INVENTION

The present invention relates to a roller. More particularly this invention concerns a support roller for a paper winding machine.

BACKGROUND OF THE INVENTION

A paper-winding machine for making up individual rolls of paper, ranging from light newsprint to heavier cardboard, typically unwinds a very large roller of paper, slits it into a plurality of strips, and winds these strips up onto individual rolls. To do this the individual strips exit from the slitter and are wound partly around at least one support roller against which press two sets of windup rolls. Each set of windup rolls includes a plurality of coaxial winding stations adapted to hold respective core sleeves on which the strips are wound to form the finished rolls. Normally the strips alternate which set they are wound up on. Such systems are described in German patent documents 3,102,894 and 3,924,612 respectively filed 29 Jan. 1981 and 26 Jul. 1989 by H. Schonmeier, in European patent publication 562,266 filed by H. Fissmann et al with a claim to a German priority of 26 Mar. 1992, and in U.S. Pat. No. 5,405,099 of R. Hehner et al.

The support roller or rollers of the machine are normally driven so that they in turn drive the respective windup rolls. They each therefore carry much or all of the weight of the windup rolls, and even when fairly empty these rolls are pressed against the support rollers with some force to ensure that the windup rolls are coiled tightly. In fact the so-called wind quality of the windup rolls is largely a function of the line load which equals the pressing force per meter of windup-roll length and of the geometric relationships in the nip between the windup roll and the support roller. The problem is therefore that, when working at high production speeds, it is very difficult to set a predetermined uniform roll hardness, which is a function of the tension between the outer layers of the windup roll, without somehow marking or otherwise damaging the paper. In addition one must avoid that air is trapped in the windup roll or that the strip not travel straight and wander off the roll.

OBJECTS OF THE INVENTION

It is therefore an object of the present invention to provide an improved support roll for a paper-winding machine.

Another object is the provision of such an improved support roll for a paper-winding machine which overcomes the above-given disadvantages, that is which produces a uniformly tightly wound roll without surface flaws, entraining air in the roll, or letting the strip run off line.

SUMMARY OF THE INVENTION

The instant invention is am improvement in a paper-winding machine wherein a paper web passes at least partially around a support roller rotating about an axis and the web is wound up on a windup roll bearing radially on the support roller and wherein the support roller comprises a rigid tubular core having a substantially cylindrical outer surface and an outer layer of material on the outer surface. The improvements are that the layer of material has a thickness between 5 mm and 12 mm (preferably 6 mm to 8 mm), the material is a low-friction elastomer (preferably a nitrile or polyurethane rubber), and the material has a Shore A hardness of between 65 and 80 (preferably 70 to 74).

According to another feature of this invention the layer has a coefficient of surface friction relative to paper of between 0.35 and 0.7, preferably between 0.45 and 0.6. This ensures that the paper will run on line while allowing tension to equalize as it moves from roller to roll. As a result one can operate at very high speeds.

The arithmetic average roughness of an outer surface of the layer measured according to DIN 4768 is between 0.5 μm and 1.5 μm in accordance with this invention. Such a surface composition prevents the outer surface from getting clogged with particles, particularly of ink or die, and ensures that the coefficient of friction will not change in the long term.

In order to increase the damping effect of the support roller it has an intermediate layer between the outer layer and the outer surface that has a thickness of 8 mm and 15 mm, preferably between 12 mm and 14 mm, and a Shore A hardness of at least 95.

BRIEF DESCRIPTION OF THE DRAWING

The above and other objects, features, and advantages will become more readily apparent from the following description, reference being made to the accompanying drawing in which.

SPECIFIC DESCRIPTION

Figure 3:
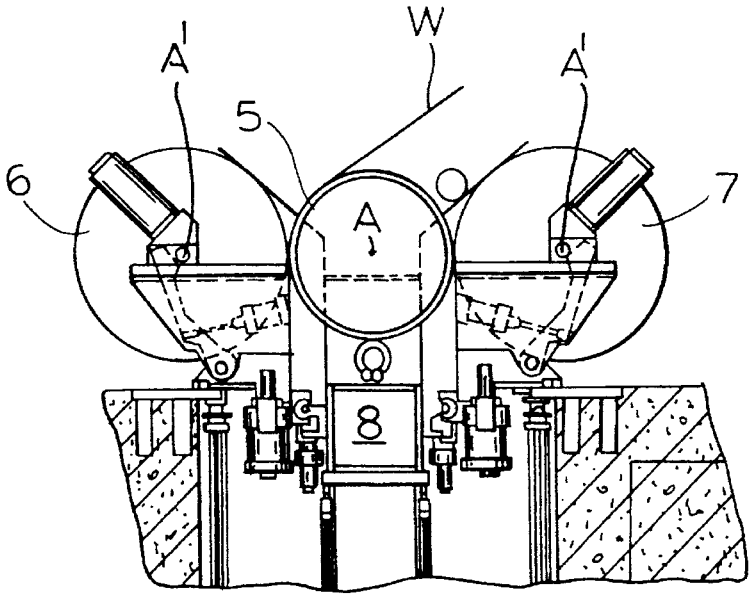
FIG. 3 is a small-scale end view of a paper-winding machine with-the inventive roller.

As seen in FIG. 3 a slitted paper web W is fed tangentially to a support roller 5 rotatable about a horizontal axis A and flanked by windup rolls 6 and 7 rotatable about parallel axes A'. A drive 8 rotates the roller 5 so that some of the strips of the web W are wound up on the rolls 6 and others on the rolls 7. This is standard and is described in the above-cited patent literature.

Figure 1:
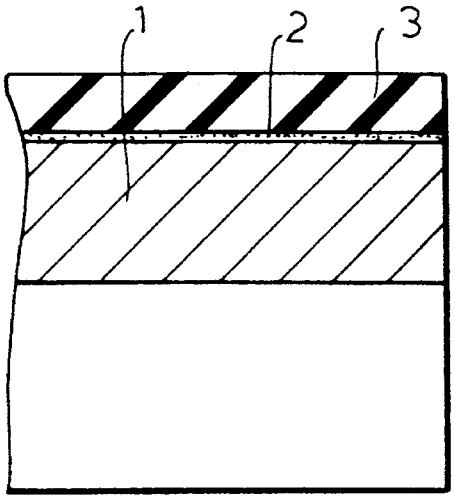
FIG. 1 is an axial section through a portion of a support roller according to the invention.

According to the invention as seen in FIG. 1 the support roller 5 comprises a tubular and rigid steel core 1 whose outer surface is provided with a thin bonding layer 2 to which is applied a thicker outer layer 3. The roller has an overall length that can be as much as 10 m and an outside diameter of 500 mm to 1500 mm. The layer 3 has a thickness between 5 mm and 12 mm (preferably 6 mm to 8 mm), the material is a low-friction elastomer (preferably a nitrile or polyurethane rubber), and the material has a Shore A hardness of between 65 and 80 (preferably 70 to 74). This hardness can also be expressed by the PJ (Pussey Jones) system as 80 to 45 PJ, preferably 60 to 70 PJ.

The layer 3 has a coefficient of surface friction relative to paper of between 0.35 and 0.7, preferably between 0.45 and 0.6. The outer surface of the roller layer 3 is ground to an arithmetic average roughness Ra measured according to DIN 4768 of between 0.5 μm and 1.5 μm This ensures that the paper runs straight on the roller 5.

Figure 2:
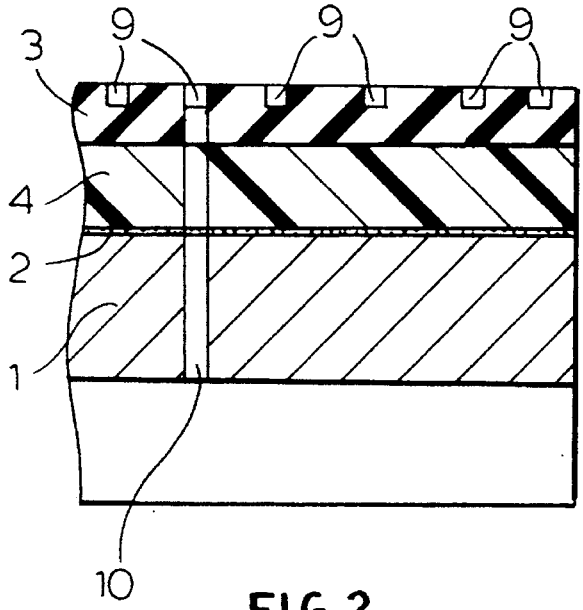
FIG. 2 is a view like FIG. 1 of another embodiment of the invention.

According to FIG. 2 there is an intermediate layer 4 between the outer layer and the outer surface that has a thickness of 8 mm and 15 mm, preferably between 12 mm and 14 mm, and a Shore A hardness of at least 95. The layer 3 can also be formed with grooves 9 to better prevent air from getting trapped between the web W and the roller 5. Furthermore radially throughgoing holes 10 traversing the core i and layers 2, 3, and 4 can further serve for the escape of trapped air, or the interior of the roller 5 can be evacuated both to carry off trapped air and adhere the web W to its surface.

The support roller according to this invention has several advantages over the prior-art systems:

The web is not marked or damaged by the support roller.

Air is not trapped between the layers of the windup rolls 6 and 7.

Modest irregularities in the thickness of the paper web are compensated for to produce a very uniform finished roll.

The displacement speed of the web W can be very high.

The web W can be counted on to run straight.

Little vibration or noise is generated by the system.

We claim:

1. In a paper-winding machine wherein a paper web passed at least partially around a support roller rotating about an axis and the web is wound up on a windup roll bearing radially on the support roller and wherein the support roller comprises a rigid tubular core having a substantially cylindrical outer surface and an outer layer of material on the outer surface, the improvements wherein the layer of material has a thickness between 5 mm and 12 mm, the material is a low-wear elastomer and directly engages the web, and the material has a Shore A hardness of between 65 and 80.

2. The support roller for a paper-winding machine defined in claim 1 wherein the thickness is between 6 mm and 8 mm.

3. The support roller for a paper-winding machine defined in claim 1 wherein the elastomer is a nitrile or polyurethane rubber.

4. The support roller for a paper-winding machine defined in claim 1 wherein the Shore A hardness is between 70 and 74.

5. The support roller for a paper-winding machine defined in claim 1 wherein the layer has a coefficient of surface friction relative to paper of between 0.35 and 0.7.

6. The support roller for a paper-winding machine defined in claim 5 wherein the coefficient is between 0.45 and 0.6.

7. The support roller for a paper-winding machine defined in claim 1 wherein the arithmetic average roughness of an outer surface of the layer measured according to DIN 4768 is between 0.5 μm and 1.5 μm.

8. In a paper-winding machine wherein a paper web passes at least partially around a support roller rotating about an axis and the web is wound up on a windup roll bearing radially on the support roller and wherein the support roller comprises a rigid tubular core having a substantially cylindrical outer surface and an outer layer of material on the outer surface, the improvements wherein the layer of material has a thickness between 5 mm and 12 mm, the material is a low-wear elastomer, the material has a Shore A hardness of between 65 and 80; and the roller further comprise an intermediate layer between the outer layer and the outer surface, the intermediate layer having a thickness of 8 mm and 15 mm and a Shore A hardness of at least 95.

9. The support roller for a paper-winding machine defined in claim 8 wherein the thickness of the intermediate layer is between 12 mm and 14 mm.

* * * * *